US008065855B2

(12) United States Patent
Wood

(10) Patent No.: US 8,065,855 B2
(45) Date of Patent: Nov. 29, 2011

(54) PATIO ENCLOSURE

(76) Inventor: Donald M. Wood, Davison, MI (US)

( * ) Notice: Subject to any disclaimer, the term of this patent is extended or adjusted under 35 U.S.C. 154(b) by 233 days.

(21) Appl. No.: 12/625,732

(22) Filed: Nov. 25, 2009

(65) Prior Publication Data

US 2010/0132285 A1 Jun. 3, 2010

Related U.S. Application Data

(63) Continuation-in-part of application No. 11/789,092, filed on Apr. 23, 2007, now Pat. No. 7,966,782, which is a continuation-in-part of application No. 11/116,081, filed on Apr. 27, 2005, now abandoned.

(60) Provisional application No. 60/566,673, filed on Apr. 30, 2004.

(51) Int. Cl.
*E04C 3/00* (2006.01)

(52) U.S. Cl. ..... 52/843; 52/79.6; 52/282.1; 52/837

(58) Field of Classification Search ..... 52/79.6, 52/282.1, 84–845, DIG. 83
See application file for complete search history.

(56) References Cited

U.S. PATENT DOCUMENTS

| | | | | | |
|---|---|---|---|---|---|
| 2,363,164 | A * | 11/1944 | Waller | 52/282.5 |
| 3,037,590 | A * | 6/1962 | Pavlecka | 52/481.2 |
| 3,377,756 | A * | 4/1968 | Polhamus | 52/220.7 |
| 3,387,418 | A * | 6/1968 | Tyrer | 52/242 |
| 3,526,074 | A * | 9/1970 | Miller | 52/844 |
| 3,708,607 | A * | 1/1973 | Brode et al. | 174/497 |
| 3,798,867 | A * | 3/1974 | Starling | 52/834 |
| 3,844,084 | A * | 10/1974 | Hubbard et al. | 52/843 |
| 4,129,974 | A * | 12/1978 | Ojalvo | 52/837 |
| D292,614 | S * | 11/1987 | Nilsson | D25/122 |
| 5,848,512 | A * | 12/1998 | Conn | 52/837 |
| 6,189,269 | B1 * | 2/2001 | De Zen | 52/220.5 |
| 6,405,504 | B1 * | 6/2002 | Richardson | 52/461 |
| 7,293,394 | B2 * | 11/2007 | Davis | 52/838 |
| 2002/0046539 | A1 * | 4/2002 | Schulz | 52/730.4 |

* cited by examiner

*Primary Examiner* — Brian Glessner
*Assistant Examiner* — Adriana Figueroa
(74) *Attorney, Agent, or Firm* — The Weintraub Group, P.L.C.

(57) ABSTRACT

An enclosed structure, such as a patio enclosure, sunroom, or solarium, is attachable to the exterior wall of a building, has a high proportion of windows and a roof, and constructed from a framework of composite members and insulating wall panels, the panels and wall members being extruded from material having improved thermal characteristics and stability.

9 Claims, 12 Drawing Sheets

34
56
48
46a
46
50
58
54
52
52a 36
62
62a
60
65
63
66
64a
64

38
72
73
70
70a
70b
72a
72b
69
69a
68a
68b
68

40
80
78a
78
76a
77
76

44
85
86
87
88
84
82
82a 14
18
22
38b
38
40
24
32
34
24
13
13
14
14
12
38a 20
14
8
22
38
38b
28
24
40
8
11
11
28
40
34
12
12
12
36
38a

FIG 9
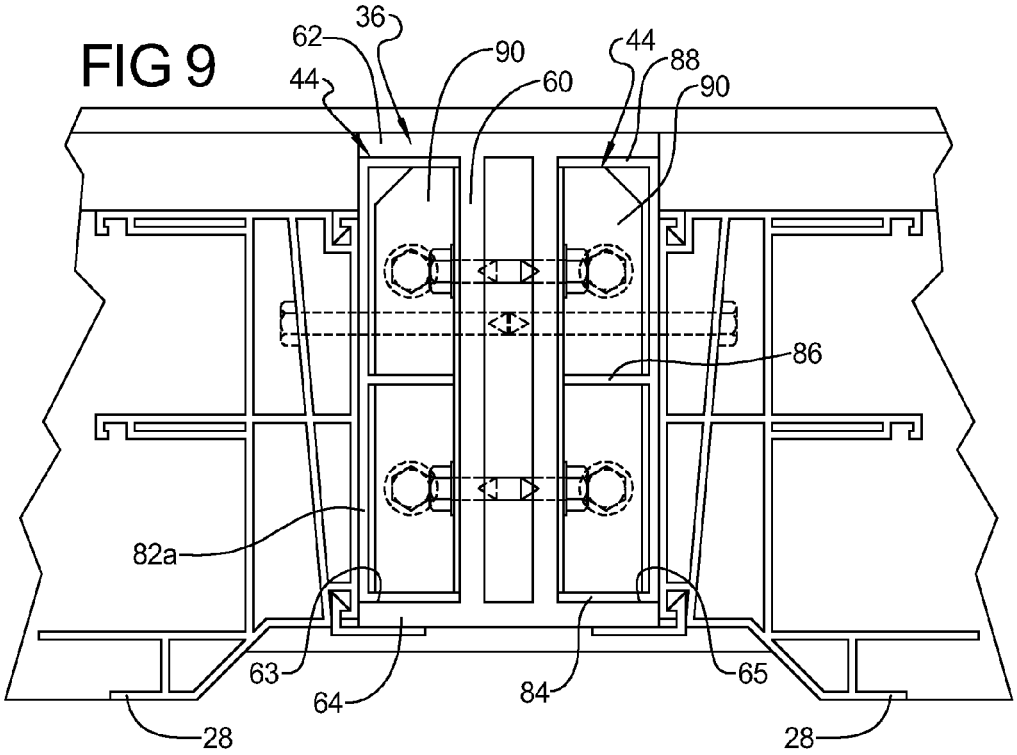
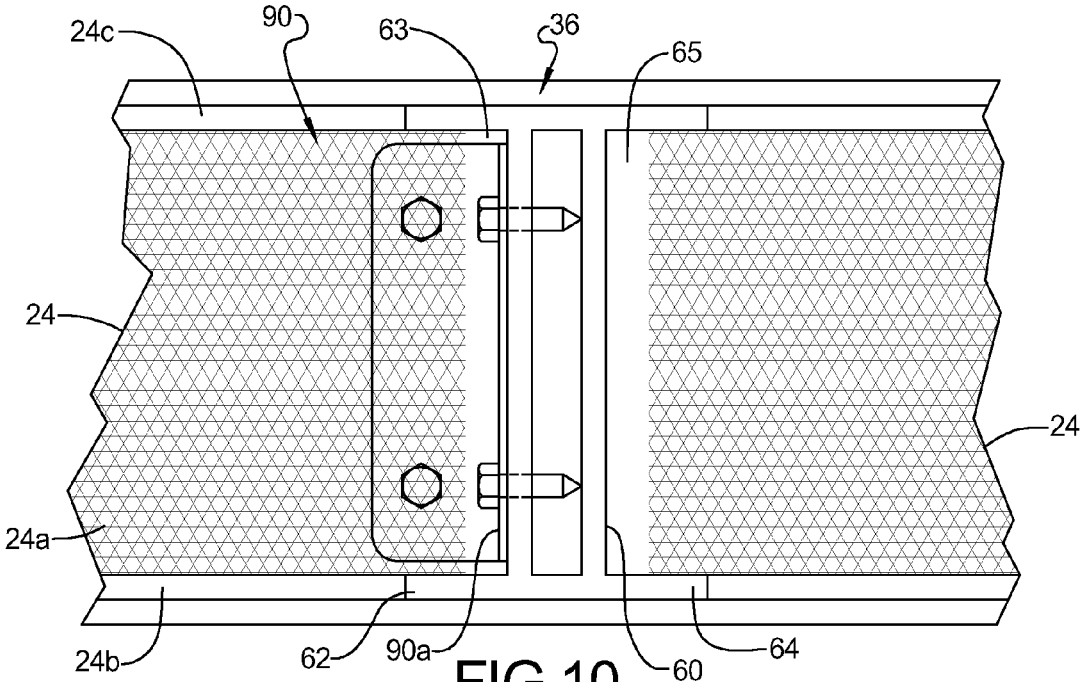
FIG 10

FIG 11
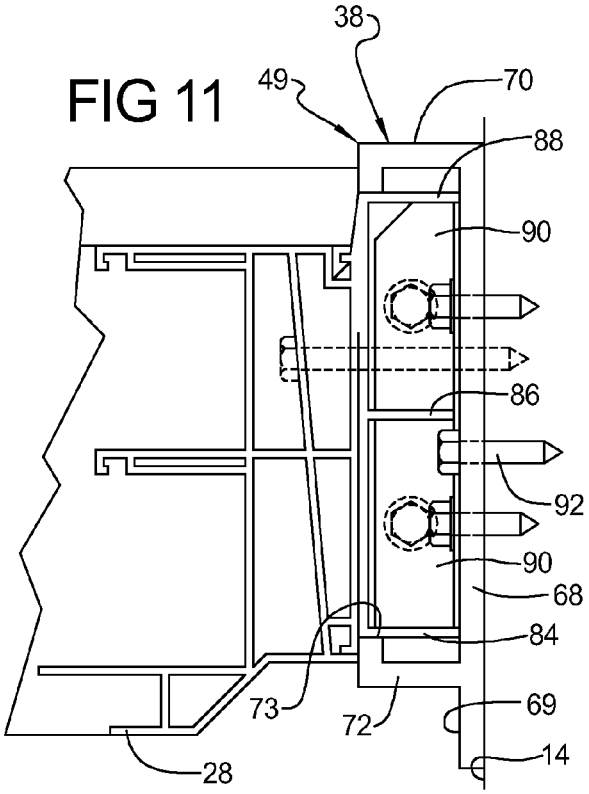
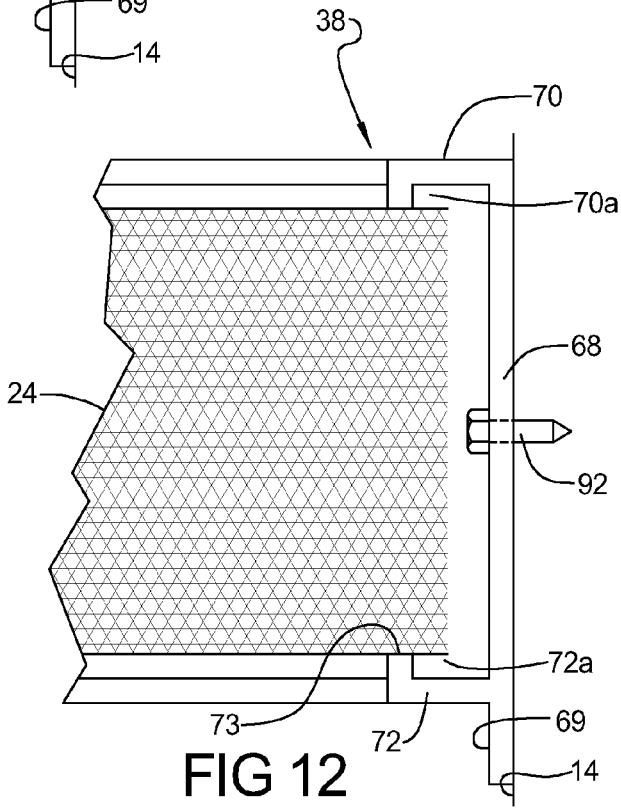
FIG 12

PATIO ENCLOSURE

CROSS-REFERENCE TO RELATED APPLICATIONS

This application is a continuation-in-part application of application Ser. No. 11/789,092, filed Apr. 23, 2007, now U.S. Pat. No. 7,966,782, which is a continuation-in-part of application Ser. No. 11/116,081, filed Apr. 27, 2005, now abandoned which claims the benefit of provisional Application No. 60/566,673, filed Apr. 30, 2004, the entire disclosures of each are hereby incorporated by reference, including all drawing figures.

BACKGROUND OF THE INVENTION

1. Field of the Invention

This invention relates to an enclosed structure that can be attached to the exterior wall of an existing or new building, such structure typically being referred to as a patio enclosure, sunroom, or solarium. More particularly, the invention relates to a patio enclosure having a high proportion of windows and a roof and constructed from a framework of composite members and insulating wall panels. Even more particularly, this invention relates to composite plastic members extruded from material having improved thermal characteristics and stability.

2. Description of Prior Art

Patio enclosures and sunrooms are not new to the building industry. When adding onto or remodeling an existing home or other structure, many people turn to the patio enclosure or sunroom. Such rooms are relatively easy for trained technicians to construct and are inexpensive when compared to other improvements that can be made to a home, such as remodeled bathrooms or kitchens. These enclosures have traditionally been constructed of an aluminum frame with windows or glass sections. Aluminum sunrooms are shaped with vertical walls that have a curved transition to the roof, although most may have a marquee roof or gable type roof.

The following United States patents and patent application Publication illustrate various enclosures, non-metallic structural elements used in constructing these enclosures, and the materials used in forming the non-metallic structural elements: U.S. Pat. No. 5,497,594 to Guiseppe et al.; U.S. Pat. No. 5,848,512 to Conn; U.S. Pat. No. 6,003,279 to Schneider; U.S. Pat. No. 6,015,611 to Deaner et al.; U.S. Pat. No. 6,117,924 to Brandt; U.S. Pat. No. 6,248,813 to Zehner; U.S. Pat. No. 6,412,227 to DeZen; U.S. Pat. No. 6,337,138 and U.S. Pat. No. 6,344,504 to Zehner et al.; U.S. Pat. No. 6,460,309 to Schneider; and 2002/0066248 to Buhrts et al.

As discussed in Schneider U.S. Pat. No. 6,003,279 and U.S. Pat. No. 6,460,309, aluminum framed enclosures have several disadvantages. The main problem is poor thermal efficiency. Due to the high rate at which aluminum conducts heat, a room constructed from aluminum cannot stay comfortably cool in the summer, without air conditioning, or warm in the winter, without supplemental heating. This drawback results in dramatically increased cooling and heating costs. Further, a high rate of heat transfer can lead to condensation on the interior surfaces of the aluminum structures. Moreover, many of the windows in aluminum frame type sunrooms are generally installed in such a way that the windows cannot be opened and no screens are present.

Another disadvantage is high maintenance. Aluminum must be painted if chipped and is easily dented. Construction of aluminum rooms is a major disadvantage as well. Because of the nature of the metal, the aluminum pieces must be assembled with external fasteners. External fasteners increase the time of assembly and degrade the overall aesthetics of the room.

In light of these various deficiencies, Schneider U.S. Pat. No. 6,003,279 discloses various structural members, which include reinforced and non-reinforced polyvinyl chloride extrusions, which are joined together at joints using hardware which cannot be seen from inside or outside the enclosure, thereby enhancing the aesthetic appeal of the enclosure. Further, Conn U.S. Pat. No. 5,848,512 and Schneider U.S. Pat. No. 6,460,309 disclose an I-beam that is extruded from plastic and configured such that the vertical spacer wall defines a central passageway that extends between the opposite ends of the beam. Schneider U.S. Pat. No. 6,460,309 is directed to a vinyl roofing system utilizing the channel beam to interconnect roof panels with a roof cap.

In obviating certain problems associated with unwanted condensation and thermal conductivity, many framing enclosure designs have used a "sleeve" approach, wherein the aluminum elements and sections are enclosed within PVC frames. A drawback to this approach is that the aluminum reinforcing still has to be properly insulated from the rest of the vinyl profile. This approach results in massive, bulky sections with high material costs.

A need continues for a low maintenance sunroom/patio enclosure that is economical, has improved thermal efficiency, minimizes thermal condensation arising from thermal transmittance, provides sliding or double hung windows and/or doorway, has an aesthetic appearance, conceals connecting fasteners, and employs fastening components that are easy to use when erecting the enclosure.

Accordingly, a primary object of this invention is the provision of a sunroom/patio enclosure that obtains the benefits of framing elements and sections of polymeric and like material, and achieves the above noted needs.

Another object of this invention is the provision of a sunroom/patio enclosure using frame elements formed of composite PVC to allow parts to have smaller cross-sections without a great degree of internal reinforcing.

As is known, steel has much lower conductivity to thermal loss than aluminum, and has higher strength properties with lower cost. Accordingly, another object of this invention is the elimination of most, if not all, aluminum components from the enclosure product, such as by replacing some frame connecting elements with galvanized steel.

Another object of this invention is the provision of an enclosure structure that shows no screw heads on the inside or the outside of the enclosure room.

A further object of this invention is the provision of an enclosure structure comprised of composite PVC to combine the properties of wood with the maintenance free advantages of vinyl.

SUMMARY OF THE INVENTION

The objects of the present invention are achieved by a room structure for attachment to a building wall, the room structure having an upright frame assembly including an upper end and formed by at least one enclosure wall and a roof structure extending between the exterior wall and the upper end of the frame assembly, the frame assembly including at least one vertically disposed axially elongated support member, the support member comprising:

an assembly of an I-beam and a closure member, the I-beam and the closure member being of substantially the same axial length;

the I-beam and the closure member each being unitary and comprised of a single piece of a non-metallic composite material;

the I-beam being axially elongated and having a central body and a pair of transverse flanges, the flanges each having a pair of opposed outer edges positioned away from the central body, the flanges and the central body defining oppositely facing squared-C shaped channels; and the closure member being axially elongated and comprising a base wall, a pair of sidewalls, and at least one support wall, the sidewalls extending from opposite edges of the base wall and the at least one support wall upstanding from a medial location along the base wall;

wherein the closure member is snap-fitted in a friction fit into the squared-C channel of the I-beam to substantially close the channel and in a manner that the base wall of the closure member and the outer edges of the flanges of the squared-C channel into which the closure member is interfitted are substantially coplanar.

According to an important aspect, the I-beam and closure member are extruded from a composite PVC plastic.

A preferred embodiment according to this invention is the provision of a beam structure for a patio enclosure, the beam structure comprising:

a support member and a filler member, said members extending longitudinally and each of a generally constant cross-sectional shape;

said support member having a base wall, first and second walls disposed generally perpendicularly to the plane of said base wall, and outer end faces disposed parallel to the plane of said base wall, the first and second walls cooperating to define an outwardly open longitudinally extending channel sized to receive said filler member; and said filler member having a base member and a pair of upstanding sidewalls adapted to frictionally engage and form a snug snap-fit engagement with a respective of said first and second walls, the base member and the outer end faces forming a generally continuous surface following said interfitment.

According to an aspect of this embodiment, the support member comprises a generally I-shaped beam member and the channel thereof has a squared-C cross-section, the filler member has a squared-C cross-section, and the I-shaped beam member and filler member are extruded, or injection molded from a synthetic wood composition.

According to another aspect of this invention, the I-shaped beam member has a pair of flange members, each forming a respective of said outer end faces, and the exterior surfaces of the outer end faces and the exterior surface of the filler member are clad with vinyl cap stock.

Another preferred embodiment according to this invention is the provision of a modular wall for a patio enclosure formed as an add-on extension to an existing structure supported on the ground and having framing structure for at least one of a window or door, the modular wall comprising:

a longitudinally extending upper and lower track beam, the lower track beam being supported on the ground;

a pair of vertically extending corner posts, each post having an upper and lower end portion and forming at least one outwardly open channel;

at least one vertically extending I-beam disposed between the posts and defining a pair of separated wall sections, the I-beam having an upper and lower end portion and forming a pair of opposed outwardly open channels;

said wall section including a lower and an upper C-shaped cross-beam, a lower and an upper wall panel, and the framing structure sandwiched between said wall panels, said cross-beam having opposite longitudinal ends, a base having an outer surface, and an outwardly open channel, said lower and upper wall panel having, respectively, upper and lower edges engaged with the outer surface of a respective cross-beam, lower and upper edges interfitted within the channel of said lower and upper track beam, and vertically disposed side edges interfitted within the channels of said corner posts and I-beam;

first means for positioning and securing the lower end portions to the lower track beam and the upper end portions to the upper track beam, wherein said track beams are disposed in generally parallel horizontal relation, said corner posts are secured and positioned at the opposite longitudinal ends of the lower track beam, and the channels of said I-beam and said corner posts are facing one another;

second means for enclosing the outwardly open channels of said corner posts and said I-beam wherein to cover said first means, at least in part; and third means for positioning and securing the opposite ends of the cross-beams to said corner post and I-beam.

According this embodiment of the invention, the second means comprises a filler beam of predetermined cross-section, said filler beam frictionally interfit in a snug-fit into the respective channel to form an exterior surface that appears to be unitary.

Further, and according to an important aspect of this embodiment, the upper and lower track beams, the corner posts, the I-beam, the cross-beams, and the filler beam are extruded or injection molded from a synthetic wood PVC composition and have exterior surfaces selectively clad with vinyl cap stock.

Another preferred embodiment according to this invention is the provision of a wall joint for a patio enclosure, which enclosure is formed as an add-on extension to an existing structure, supported on the ground, and has framing structure for at least one of a window or door, the wall joint comprising:

a first pair of longitudinally extending upper and lower track beams and a second pair of longitudinally extending upper and lower track beams, the first pair of track beams being disposed at a right angle to the second pair of track beams and each said lower track beam being supported on the ground;

a vertically extending corner post, said post having a lower and upper end portion and forming outwardly open first and second channels, the channels being disposed at right angles to one another;

a vertically extending first and second wall section, each said wall section including upper and lower end portions that are juxtaposable with and extend along a respective pair of said lower and upper track beams, said first wall section having a first vertical edge that is juxtaposable with the first channel of said corner post and at least one framing structure, and said second wall section having a second vertical edge that is juxtaposable with the second channel of said corner post and at least one framing structure;

first means for securing and positioning the lower end portion of said corner post and said lower track beams to said support wherein the first and second channels are juxtaposed with the ends of the lower track beams;

second means for securing and positioning the upper end portion of said corner post to said upper track beams;

third means for enclosing the outwardly open first and second channels of said corner post wherein to cover each said first and second means, at least in part; and fourth means for connecting the wall sections to the track beams and said corner post.

Another preferred embodiment according to this invention is the provision of a new and improved extruded article, said article produced by extruding a cellulosic inorganic-filled plastic composite, the composite consisting of a bound together mixture of polyvinyl chloride, a cellulosic material selected from the group consisting of sawdust, finely pulverized dried wood, and wood flour, baking flour, and a binder.

A further preferred embodiment according to this invention comprises a kit for constructing an enclosure to the exterior wall of an existing structure, said kit comprising:

a plurality of wall panels of predetermined height, width, and thickness;

a framing structure, such as for providing at least one window or door, as required;

a plurality of elongated track beams, the track beams forming upper and lower end caps of front and side walls formed by the kit and each having a central track;

a plurality of vertical uprights of I-shaped cross-section, the vertical uprights forming two opposed outwardly opening C-shaped channels;

a plurality of C-shaped cross-beams, the cross-beams having an outwardly open C-shaped channel;

a plurality of corner posts of substantially square cross-section and forming two outwardly open channels of squared-C cross-section;

means for positioning and securing the wall panels, framing structure, track beams, I-beams, C-shaped cross-beams, and corner posts to one another and the support structure; and a plurality of closure members of squared-C cross-section, the closure members being snap-fittable into a respective C-shaped channel provided in the I-beam and corner post, wherein to close the channel and form a unitary appearing exterior.

Preferably, and according to this embodiment of the invention the track beams, I-beam, corner-post, C-shaped cross-beam, and closure members of the kit are extruded or injection molded of a composite PVC, with predetermined exterior surfaces of each clad with a protective surface of vinyl.

BRIEF DESCRIPTION OF THE DRAWINGS

These and other objects, advantages and features of the invention will become apparent from the following description taken in conjunction with the accompanying drawings, which illustrate specific embodiments of the invention. In the drawings:

FIG. 9 is a section view of the front wall taken along line 9-9 of FIG. 2 showing two window channels separated by an I-beam, and a pair of L-shaped flanges and a pair of E-shaped filler channels interfitted into oppositely facing outwardly open channels of the I-beam, the flanges for connecting the I-beam to the a track member, and thus to the ground structure;

FIG. 10 is a section view of the front wall taken along line 10-10 of FIG. 2 showing opposite edges of front wall panels and an L-shaped flange for connecting the beam to the ground structure interfitted into oppositely facing outwardly open channels of the I-beam;

FIG. 11 is a section view of the right side wall taken along line 11-11 of FIG. 4 showing a C-shaped track member connected to the exterior wall, a window channel, and an E-shaped filler and an L-shaped flange interfitted into an outwardly open channel of the track member;

FIG. 12 is a section view of the right side wall taken along line 12-12 of FIG. 4 showing a track member disposed vertically and connected to the exterior wall and a vertical edge portion of an enclosure panel interfitted into the track member;

DETAILED DESCRIPTION OF THE PREFERRED EMBODIMENTS

Referring to FIGS. 1 and 2-4, there is shown an exemplary patio enclosure, generally indicated at 10, constructed according to the present invention. The enclosure 10 is supported from below by a load-bearing substrate 12 and laterally by an exterior wall 14 of an existing structure, such as a house (not shown). The load bearing substrate 12 may be a concrete slab, wood decking, or the like.

Figure 1:
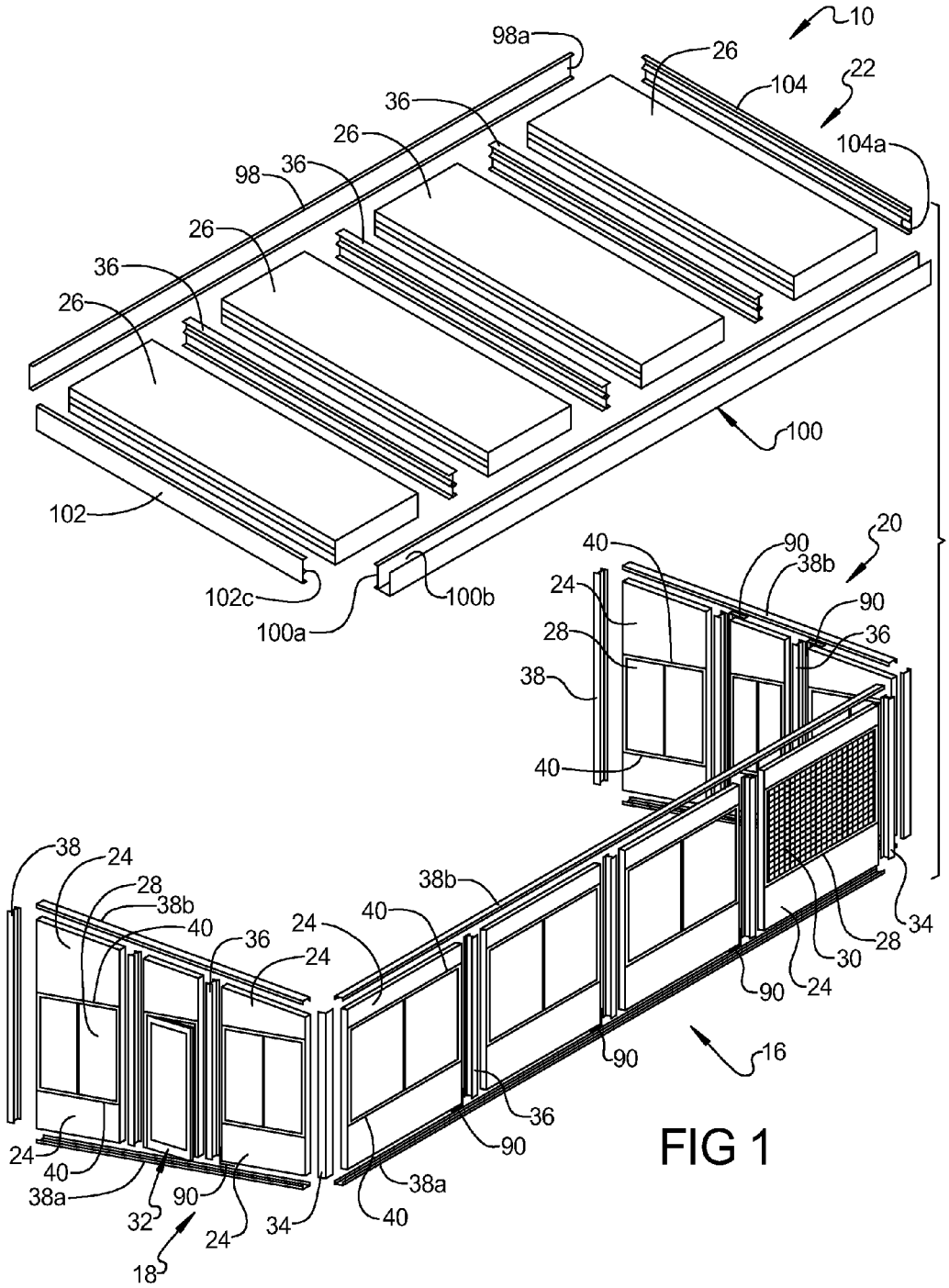
FIG. 1 is an exploded perspective view of a patio enclosure positioned for assembly using a variety of frame members and structural elements according to this invention.

As shown in FIG. 1, the enclosure 10 comprises a front wall 16, a pair of lateral side walls 18 and 20, and a sloping roof 22. The walls 16, 18, and 20 project upwardly from the substrate 12 where they are joined to the roof 22. The sidewalls 18 and 20 have opposite lateral ends connected, respectively, to the house and a respective lateral end of the front wall 16.

The walls and roof of the enclosure 10 are formed by a framework of joined horizontal and vertical structural members, such as structural filler wall panels 24 and roof panels 26, multiple pairs of sliding glass windows 28, framed screens 30 for each pair of windows (one shown), and an optional conventional door assembly 32.

Figure 6:
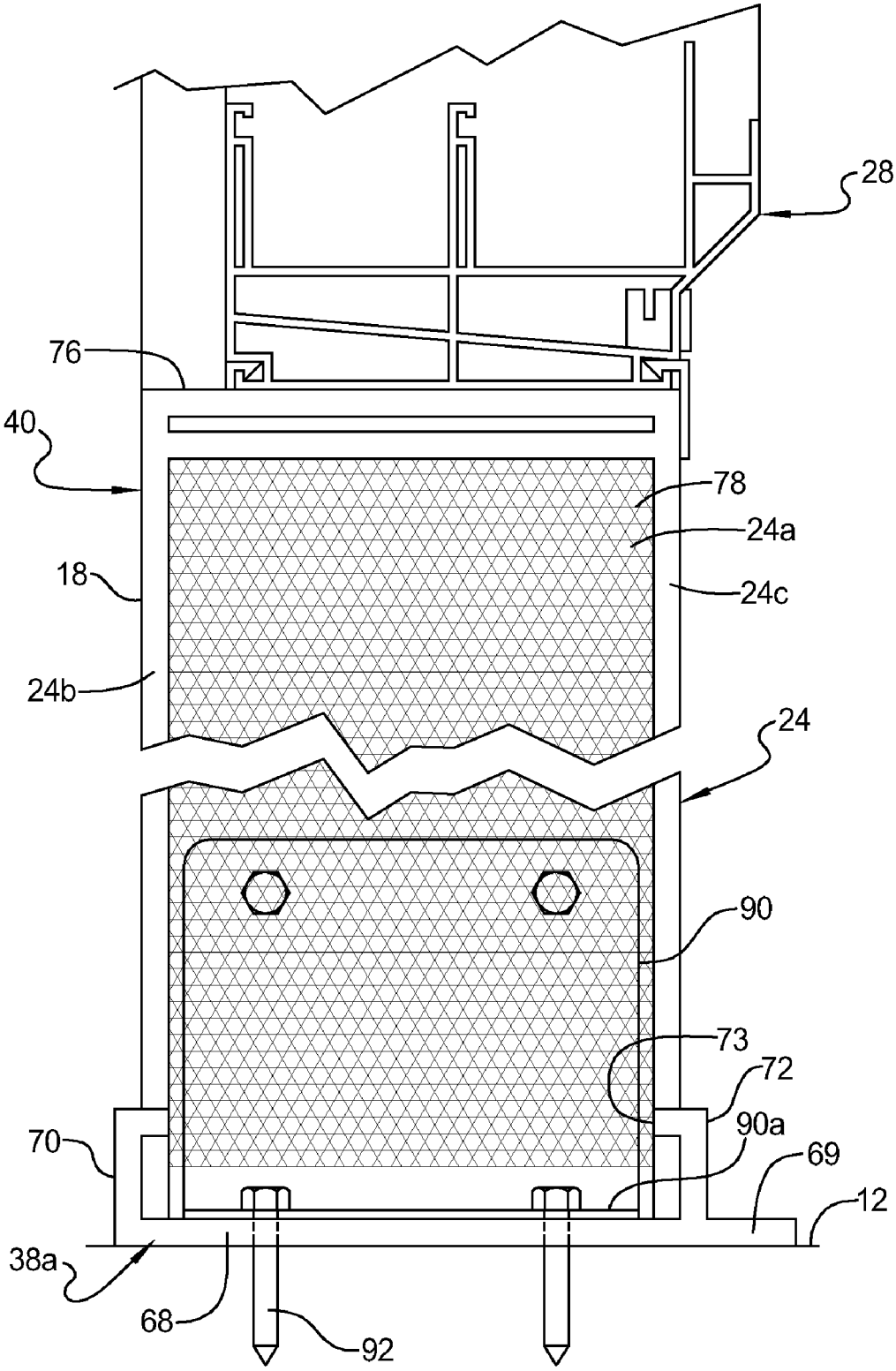
FIG. 6 is a section view of the front wall taken along line 6-6 of FIG. 2 showing a C-shaped channel member disposed horizontally, the bottom edge of a window channel supported on the channel member, the upper and lower edges of a front wall panel received in the channel member and lower track member, and a connection, which extends along and connects the front wall of the enclosure to the ground structure.

As shown in FIG. 6, each wall panel 24 is generally rectangularly shaped and has a central body 24*a* of polymeric material, such as foam, and outer layers 24*b* and 24*c* to provide a wall panel element of generally uniform thickness. The thickness of the wall panel 24 is such that the lateral edges thereof may be interfitted into a squared-C channel of a structural element according to this invention (described in detail below). Preferably, both of the layers 24*b* and 24*c* are clad with vinyl.

Preferably and according to this invention, certain of the structural elements used in this assembly are shown and identified on FIGS. 1A-1E. These structural elements include a corner post 34, an I-beam 36, a base track 38, a cross-beam channel 40, and a closure member 44. As will be discussed below, nails, screws and like threaded fasteners, flanges and like connecting elements are used to connect the structural elements together and form modular wall portions and the patio enclosure 10.

Preferably and according to this invention, each of the structural elements are comprised of a composite PVC material and extruded into the desired cross-section and length. Subsequent to extrusion, a vinyl surface is clad to the exterior surfaces of the structural elements. The resulting element is sometimes referred to as a composite PVC element. The structural elements made from the composite PVC material are generally stronger than wood, metal, or vinyl, yet they have the durability of vinyl and have no adverse heat conduction, such as associated with metals. Although extrusion is a preferable method, these elements can be injection molded.

According to one aspect, the composite material comprises a bound together mixture of cellulosic material (e.g., sawdust, wood flour, or like finely pulverized dried wood) and baking flour (e.g., the fine powdery foodstuff obtained by grinding and sifting the meal of a grain, especially wheat, used chiefly in baking). Suitable woods for sawdust are resin-free softwoods such as pine, fir and spruce, and to a lesser extent, hardwoods. The percentage of sawdust to baking flour, measured by weight or volume, and a binder and/or mixer ingredient used to hold the composition together is determined, in part, on a cross-section property of the structural element that is desired (i.e., thickness and area moment of inertia of the cross-section).

Figure 1A:
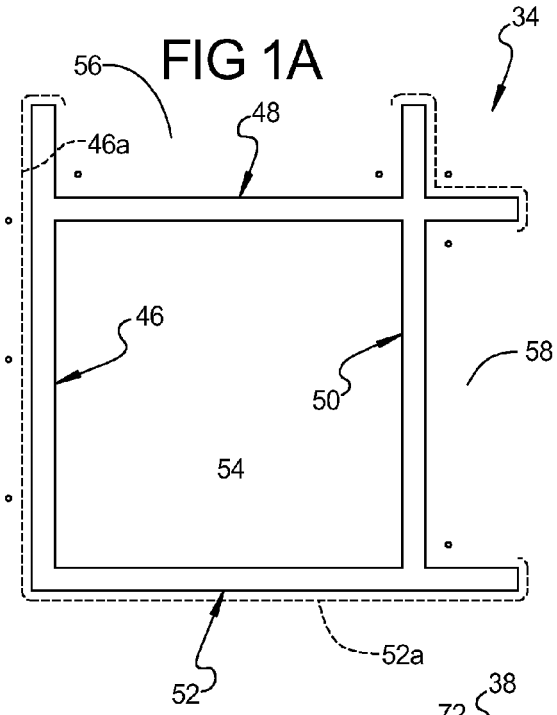
FIGS. 1A-1E are cross-sectional views of structural elements used in assembling the enclosure of FIG. 1.

Referring to FIG. 1A, the corner post 34 is box-like in cross-section, axially elongated, and formed by walls 46, 48, 50, and 52. The walls intersect with one another to form a substantially square-shaped central opening 54 and a pair of outwardly open squared-C shaped channels 56 and 58 for receiving the lateral edge of a wall panel 24. The walls 46 and 52 form an exterior corner with the outwardly facing surfaces 46*a* and 52*a* thereof clad with vinyl, so as to provide protection from the elements.

Figure 1B:
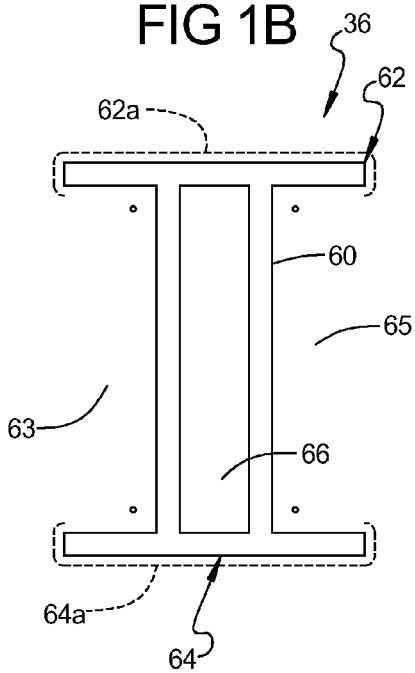

Referring to FIG. 1B, the I-beam 36 is axially elongated and includes a central body 60 and a pair of transverse flanges 62 and 64, which define oppositely facing squared-C shaped channels 63 and 65. The exterior surfaces 62*a* and 64*a* of the flanges 62 and 64 are clad with vinyl and the central body 60 is hollow and defines a central rectangular-shaped passageway 66.

Figure 1C:
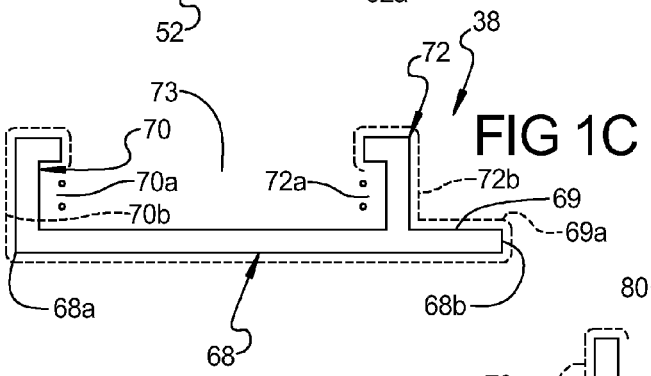

Referring to FIG. 1C, the base track 38 is axially extending and includes a flat base member 68 having opposite lateral edges 68*a* and 68*b* and a pair of opposed L-shaped arms 70 and 72, the arms 70 and 72 being spaced apart and defining a track 73 therebetween. The L-shaped arms 70 and 72 are generally perpendicular to the plane of the base member 68 and define opposed squared-C shaped channels 70*a* and 72*a* that are in faced relation and communicate with the central track 73. The arm 70 extends along and upstands from the lateral edge 68*a* of the base member 68. The arm 72 extends along and upstands from the base member 68 at a location inwardly of the lateral edge 68*b* of the base member 68 wherein to define an offset base portion 69. The exterior surfaces 70*b*, 72*b*, and 69*a*, respectively, of the upstanding arms 70 and 72 and the offset base portion 69 are clad with vinyl.

Figure 1D:
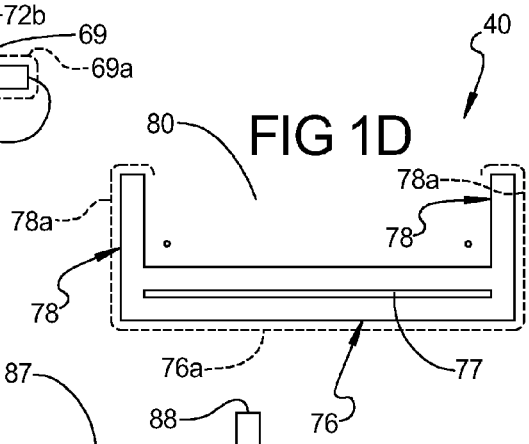

Referring to FIG. 1D, the cross-beam channel 40 is axially extending and forms a generally squared-C shape in cross-section. The channel 40 includes a base member 76 and a pair of opposed upstanding legs 78 defining a squared-C shaped channel 80 having a width adapted to receive the lateral edge of a wall panel 24 interfitted therewithin. The base member 76 is hollow and defines a central rectangular shaped passageway 77. The exterior surfaces 76*a* and 78*a*, respectively, of the base member 76 and the legs 78 are clad with vinyl.

Figure 1E:
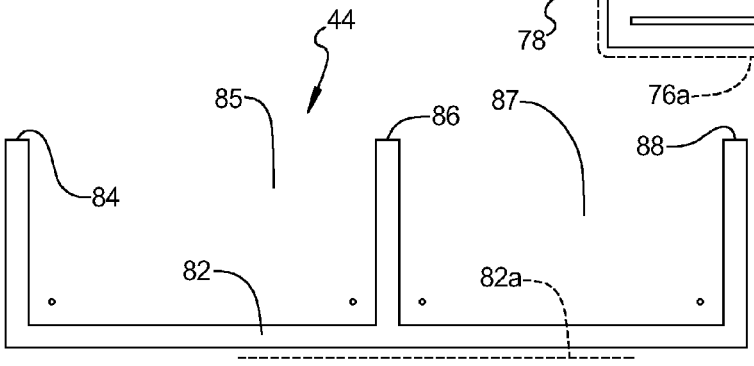

Referring to FIG. 1E, the closure member 44 is axially elongated and generally E-shaped in cross-section. The closure member 44 includes a base wall 82, a pair of sidewalls 84 and 88, and at least one support wall 86. The sidewalls 84 and 88 extend from opposite edges of the base wall 82. The at least one support wall 86 is upstanding from a medial location along the base wall 82. When one support wall 86 is provided, closure member is E-shaped in cross-section. The legs 84 and 86, and the legs 86 and 88, respectively, cooperate to form two squared-C shaped channels 85 and 87. The exterior surface 82*a* of the central base member 80 is clad with vinyl.

Figure 2:
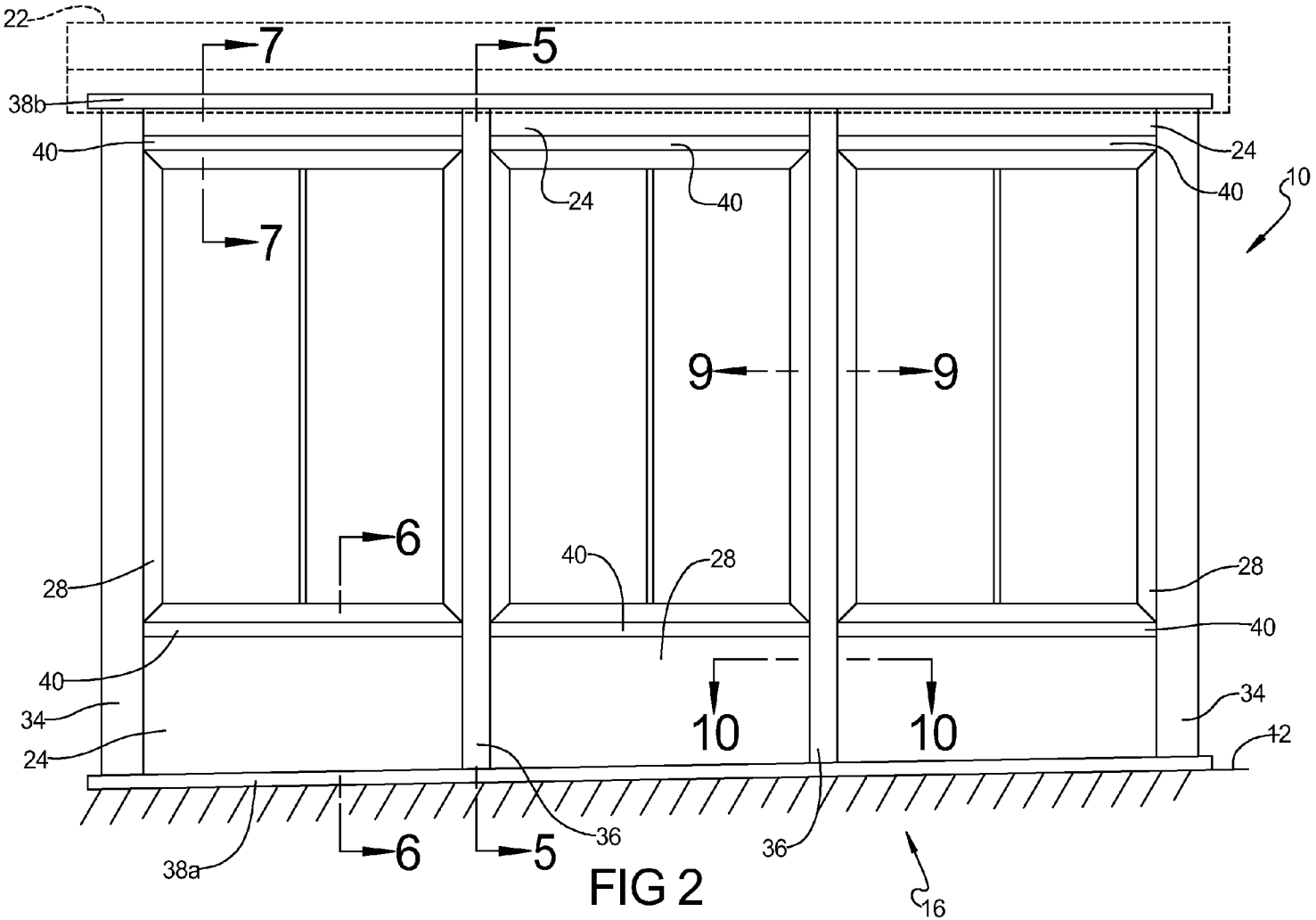
FIG. 2 is an elevation view showing the front side of the patio enclosure of FIG. 1, following assembly to an exterior wall of a house.
Figure 3:
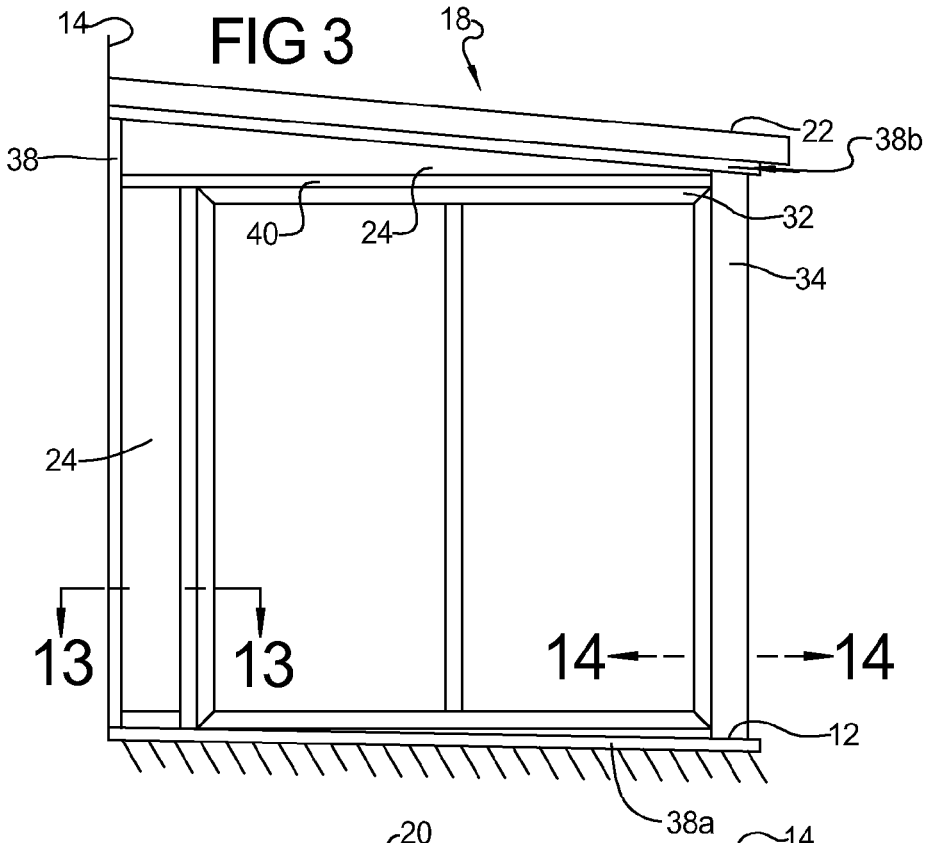
FIG. 3 is an elevation view showing the left side of the patio enclosure of FIG. 2.
Figure 4:
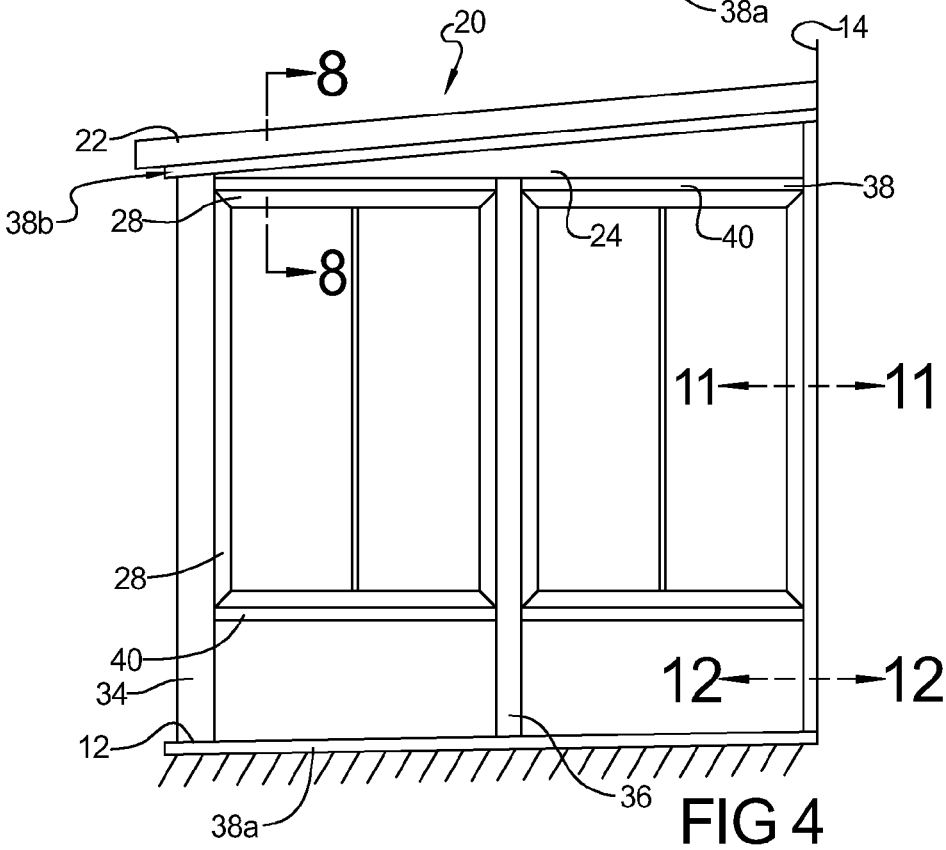
FIG. 4 is an elevation view showing the right side of the patio enclosure of FIG. 2.

As shown in FIGS. 1 and 2-4, the front, left, and right walls 16, 18, and 20 of the enclosure 10 are assembled using the various structural elements 36, 38, 40, 42, and 44 and wall panels 24. As shown in FIG. 2, the front wall 16 is defined by and extends between two corner posts 34 and includes two I-beams 36 to define three modular wall portions, each portion including a window framing 28 and wall panels 16. As shown in FIGS. 3 and 4, the left and right side walls 18 and 20 are defined by and extend between a corner post 34 and a base track 38. The right side wall 20 includes an I-beam 36 and defines two modular wall portions and the left side wall 18 includes optional door framing 32.

Figure 5:
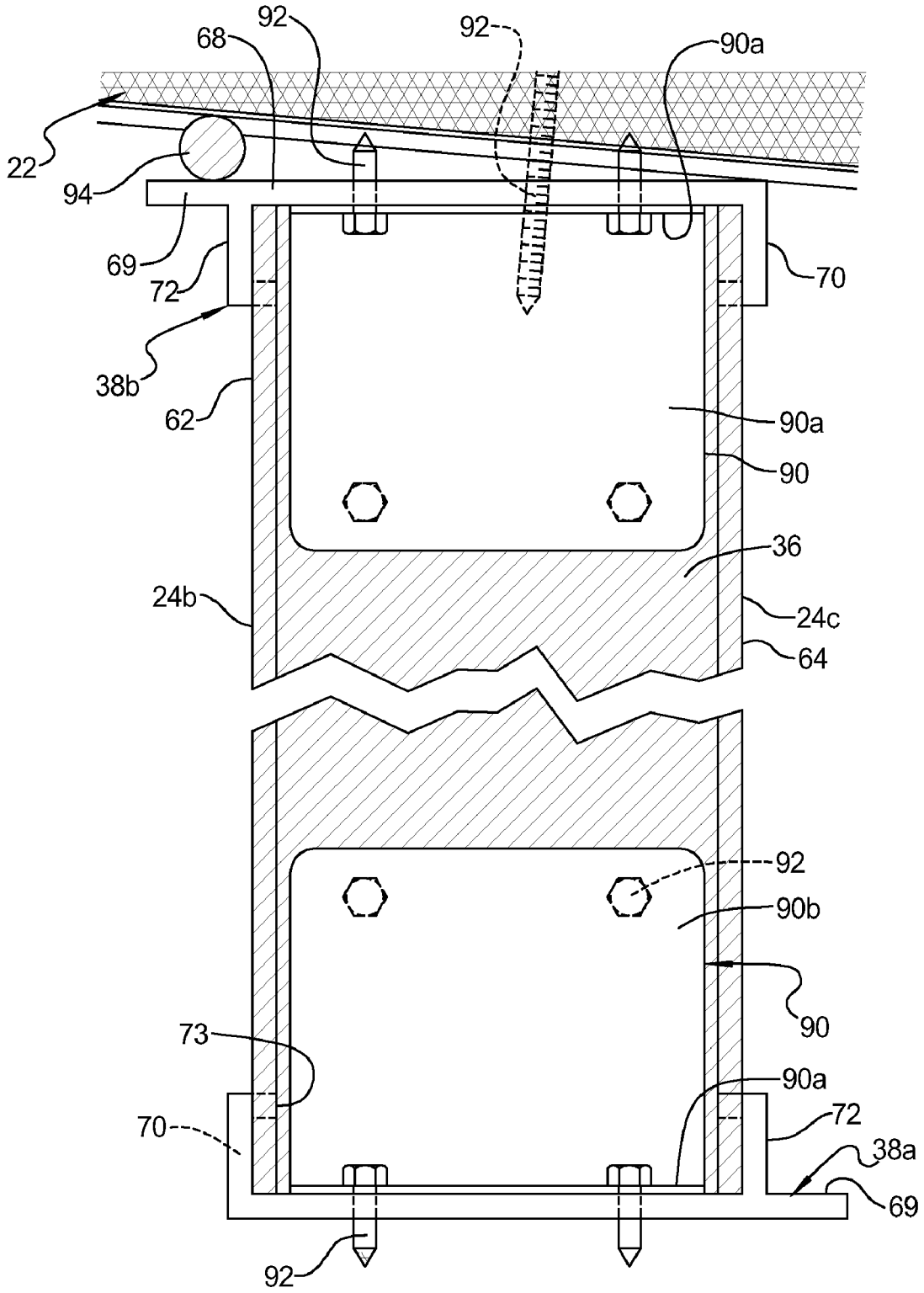
FIG. 5 is a section view of the front wall taken along line 5-5 of FIG. 2 showing an I-beam disposed vertically, C-shaped upper and lower track members disposed horizontally, L-shaped flanges securing the opposite ends of the beam to the track members, and connections that extend along the top and bottom ends of the front wall of the enclosure and connect the upper track member to the lower front end of the roof structure and the lower track member to the ground structure.

As shown in FIG. 5, the modular wall portion of the front wall 16 includes elongated lower and upper base tracks 38, denoted as 38*a* and 38*b* and disposed horizontally, and an I-beam 36 disposed vertically. L-shaped flanges 90 are secured at predetermined locations along the lower and upper base tracks 38*a* and 38*b* and properly space and secure the I-beams 36 and the corner posts 34 in a manner to receive wall panels 24, or door or window framing 28 and 32.

The lower base track 38*a* is positioned atop the substrate 12 and secured thereto by an L-shaped flange 90 and at least one threaded fastener 92. The flange 90 has opposite legs 90*a* and 90*b* and is nested in the track 73 formed between the opposed L-shaped arms 70 and 72 of the base member 68 with the flange leg 90*a* seated atop the base member 68 of the base track 38*a* and the flange leg 90*b* extending vertically upwardly from the base track. Fasteners 92 extend through the flange leg 90*a*, the base member 68, and into the substrate 12.

The upper track 38*b* forms the upward vertical extension of the front wall 24 and is secured, at least in part, to the upward vertical extension of the I-beam 36. As with the track 38*a*, the upper track 38*b* is provided with flanges 90.

The lower and upper ends 36*a* and 36*b* of the I-beam 36 are nested into a respective track 73 formed between the opposed L-shaped arms of each respective track 38*a* and 38*b*. So positioned by the flanges 90 secured to the lower and upper tracks 38*a* and 38*b*, the flange leg 90*b* extending upwardly from the lower track 38*a* is threadably secured to the lower end portion of the I-beam, and the flange leg 90*b* extending downwardly from the upper track 38*b* is threadably secured to the upper end portion of the I-beam.

A wall panel 24 is inserted downwardly into one of the opposed squared-C channels of successive I-beams 36 or corner post 34 and I-beam 36. As can be seen in FIG. 5, the protective outer layers 24*b* and 24*c* of the panel 24 are generally coextensive (i.e., flush) with the outward extension of the flanges 62 and 64 of the I-beam 36.

The upper track 38*b* forms a closure cap and support for a forward lower front end of the roof structure 22. To provide support and sealing, an axially elongated, generally cylindrical strand 94 of elastomeric material is supported atop the upper track 38*b*, on the extended base portion 74 thereof, and supports and moisture seals the roof structure 22 of the enclosure 10.

As shown in FIG. 6, a cross-beam channel 40 is interfitted onto and supported atop the upper lateral horizontally extending edge of the wall panel 24. Further, window framing 28 is thereafter supported atop the cross-beam channel 40.

Figure 7:
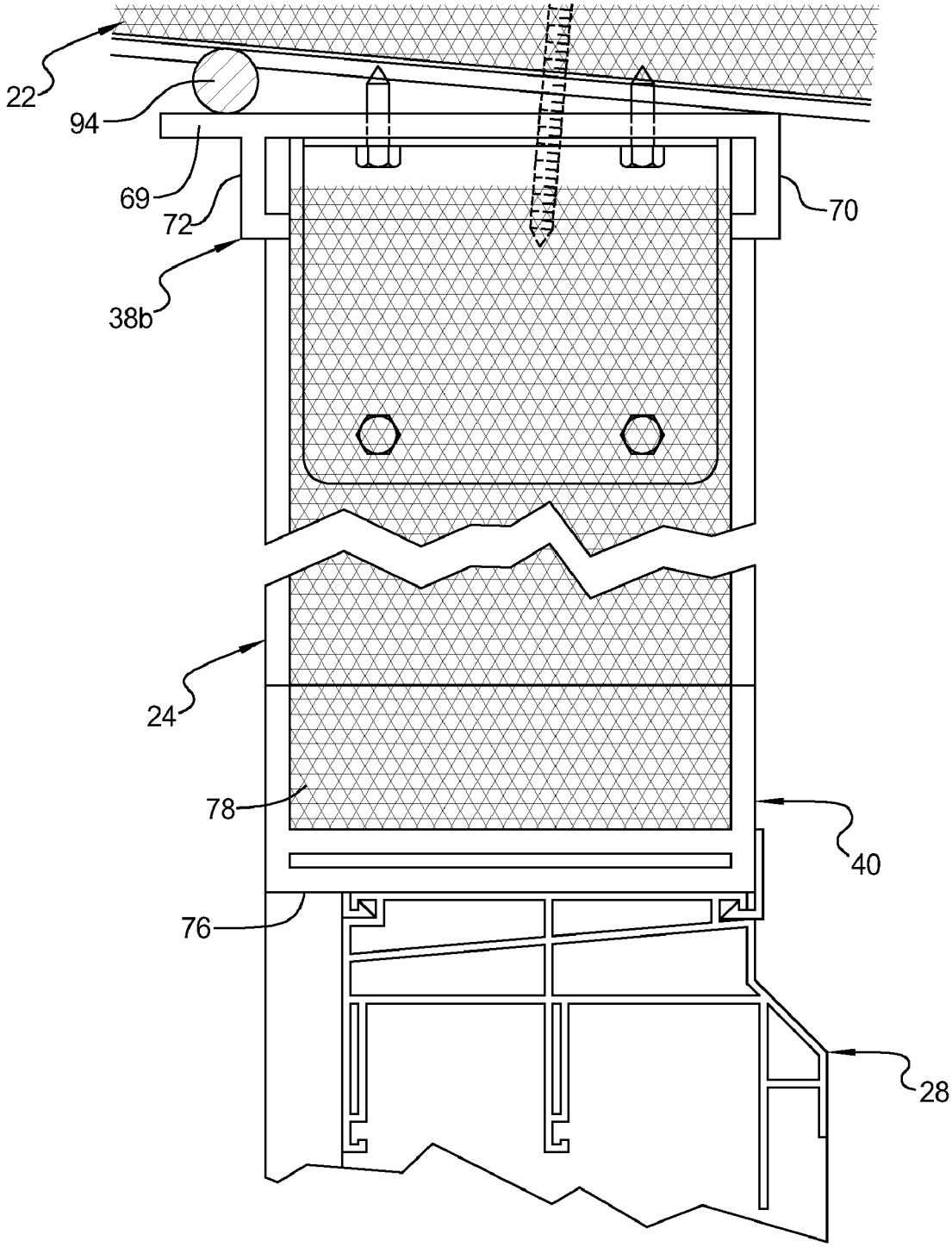
FIG. 7 is a section view of the front wall taken along line 7-7 of FIG. 2 showing the upper track member, the top edge of the window channel supporting a channel member, the upper and lower edges of a the front wall panel received in the upper track member and the channel member, and the connection between the upper track member and the roof structure.

As shown in FIG. 7, a cross-beam channel 40 is interfitted onto the lower lateral horizontally extending edge of the wall panel 24. Further, window framing 28 is thereafter abutted against the cross-beam channel 40. In a manner described in connection with FIG. 5, the upper track 38*b* and strand 94 are shown in relation to the roof structure 22.

Figure 8:
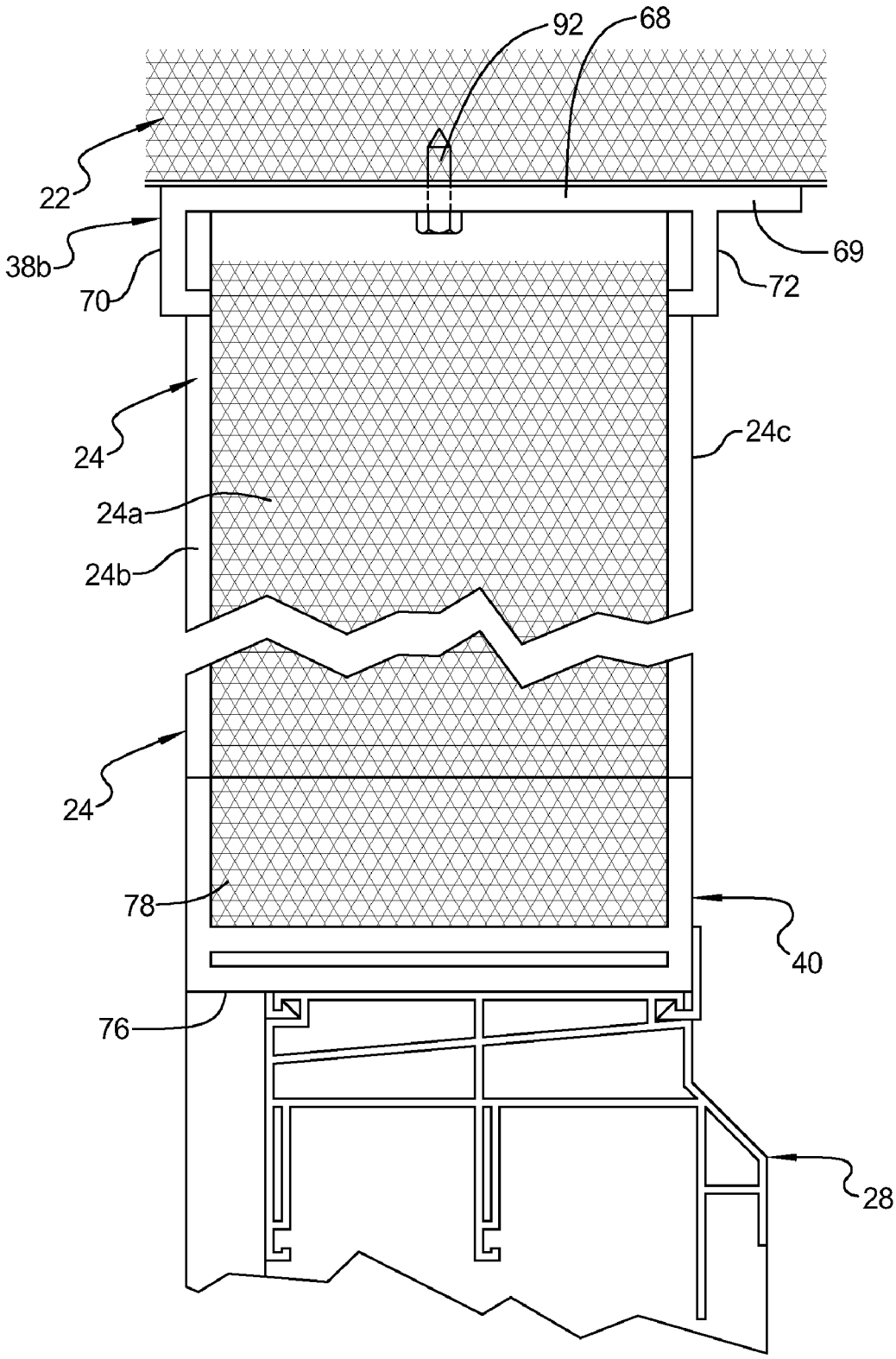
FIG. 8 is a section view of the right side wall taken along line 8-8 of FIG. 4 showing a channel member, the top edge of a window channel supporting the channel member, the upper and lower edges of a right side wall panel received in the upper and channel members, and a connection between the upper track member and the roof structure, which extends along and between the lower front and upper rearward end of the roof structure of the enclosure.

As shown in FIG. 8, the upper track 38*b* of the right wall 20 is shown supporting the roof structure 22. The right wall 22 includes an upper track 38*b*, a wall panel 24, and window framing 28. Because the upper end of the right wall 20 angles upwardly and is supporting relation with the bottom surface of the roof structure 22, the support strand 94 is not needed. Further, the base portion 74 extends in a direction outwardly of the enclosure 10.

As shown in FIG. 9, an I-beam 36 is shown separating two window framing sections 28, and L-shaped flanges 90 are connected to opposite sides of the central body 60 extending between the flanges 62 and 64 of the I-beam.

A closure member 44 is inserted into at least one of the two opposed squared-C channels 63 and 65 of the I-beam, thereby providing a flush surface with the respective channel for abutting an object such as a window and concealing the flanges 90. The closure member 44 and the respective channel of the I-beam define an elongated access space therebetween for containing, or running, electrical wiring.

According to this invention, the cross-sections of the closure member 44 and the squared-C channels 63 and 65 of the I-beam are such that the closure member 44 forms, with the flanges and channels of the I-beam, a closure that makes the beam and filler elements appear as one unitary structure. That is, the base surface 82*a* of the closure member 44 and the surfaces formed by the lateral edges of the respective flanges 62 and 64 are substantially coextensive with one another. The interfitment between the outer legs 84 and 88 of the closure member 44 and the interior facing walls of the flanges 62 and 64 results in a snug frictional snap-fit interengagement.

As shown in FIG. 10, the opposed squared-C channels 63 and 65 of an I-beam 36 are shown receiving opposite respective lateral vertical edges of a respective pair of panels 24, and a flange 90 positioning the I-beam 36.

As shown in FIG. 11, a base track 38 is disposed vertically and connected to the existing structure 14, and window framing 28 of the left side wall 18 is shown relative to the track.

Further and according to this invention, the cross-sections of the closure member 44 and the central track 73 of a base track 38 are such that the closure member 44 forms, with the central track 73, a closure that makes the two elements appear as one unitary structure. The interfitment between the outer legs 84 and 88 of the closure member 44 and the interior facing ends of the L-shaped arms 70 and 72 of the base track 38 results in a snug snap-fit frictional interengagement.

As shown in FIG. 12, a base track 38 is threadably fastened to the exterior wall 14 and the vertical lateral edge of a wall panel 24 is interfitted within the track 73 formed between the opposed L-shaped arms 70 and 72 of the base track 38.

Figure 13:
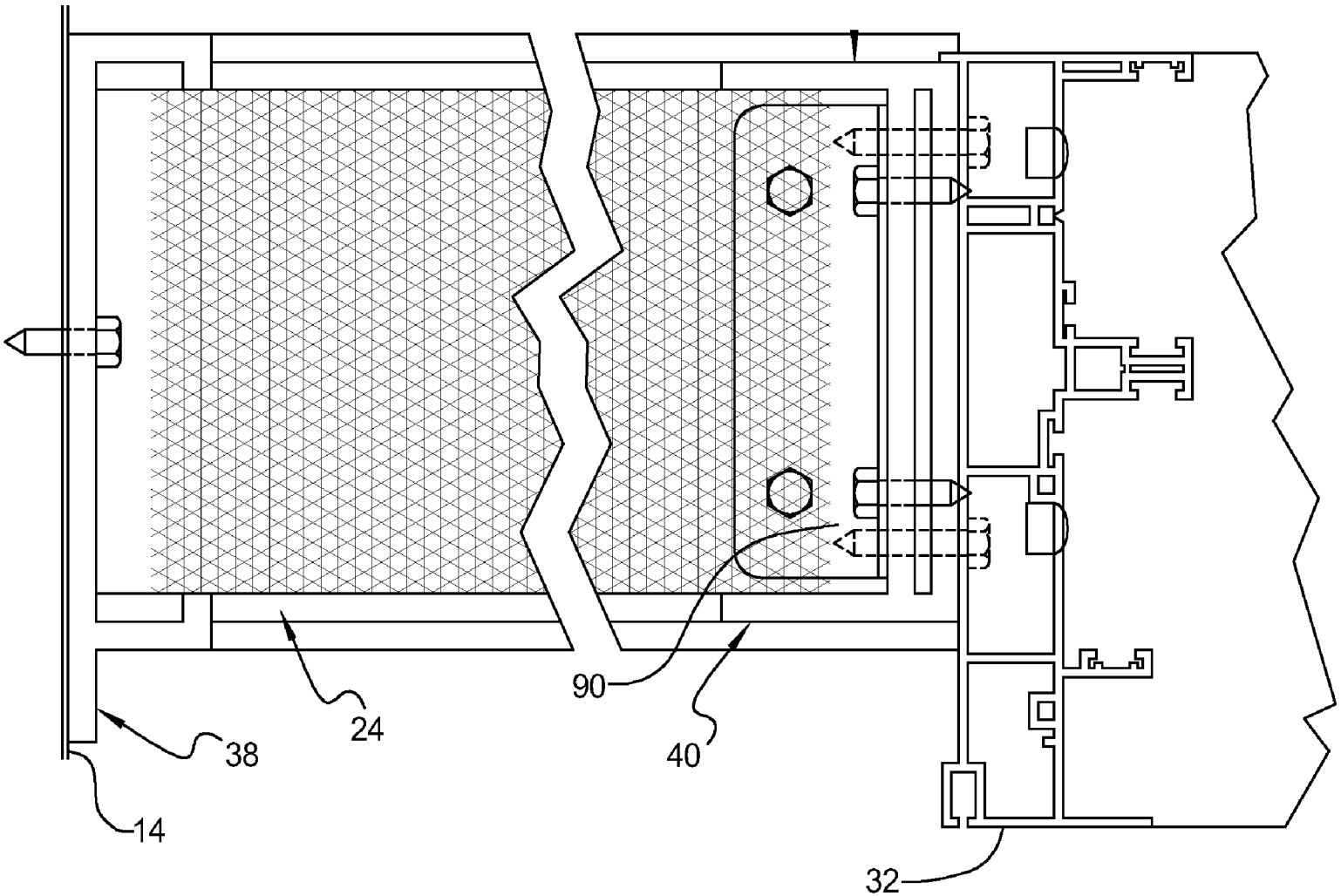
FIG. 13 is a section view of the left side wall taken along line 13-13 of FIG. 3 showing a C-shaped track member disposed vertically and connected to the exterior wall, a C-shaped track disposed vertically and connected by an L-shaped flange to the lower track, and thus to the ground structure, and a wall panel having opposite vertical edges interfitted into opposed channels of the track members.

As shown in FIG. 13, a base track 38, a wall panel 24, and a cross-beam channel 40 extend vertically upwardly from their connection to a horizontally extending lower base track (not shown). The opposite lateral vertically disposed edges of the wall panel 24 are interfitted within the central track 73 and squared-C channel 80 formed by the vertically disposed base track 38 and cross-beam channel 40. A flange 90 positions and secures the lower end of the cross-beam channel 40 relative to the lower base track. Further, the cross-beam channel 40 positions associated window framing 28.

Figure 14:
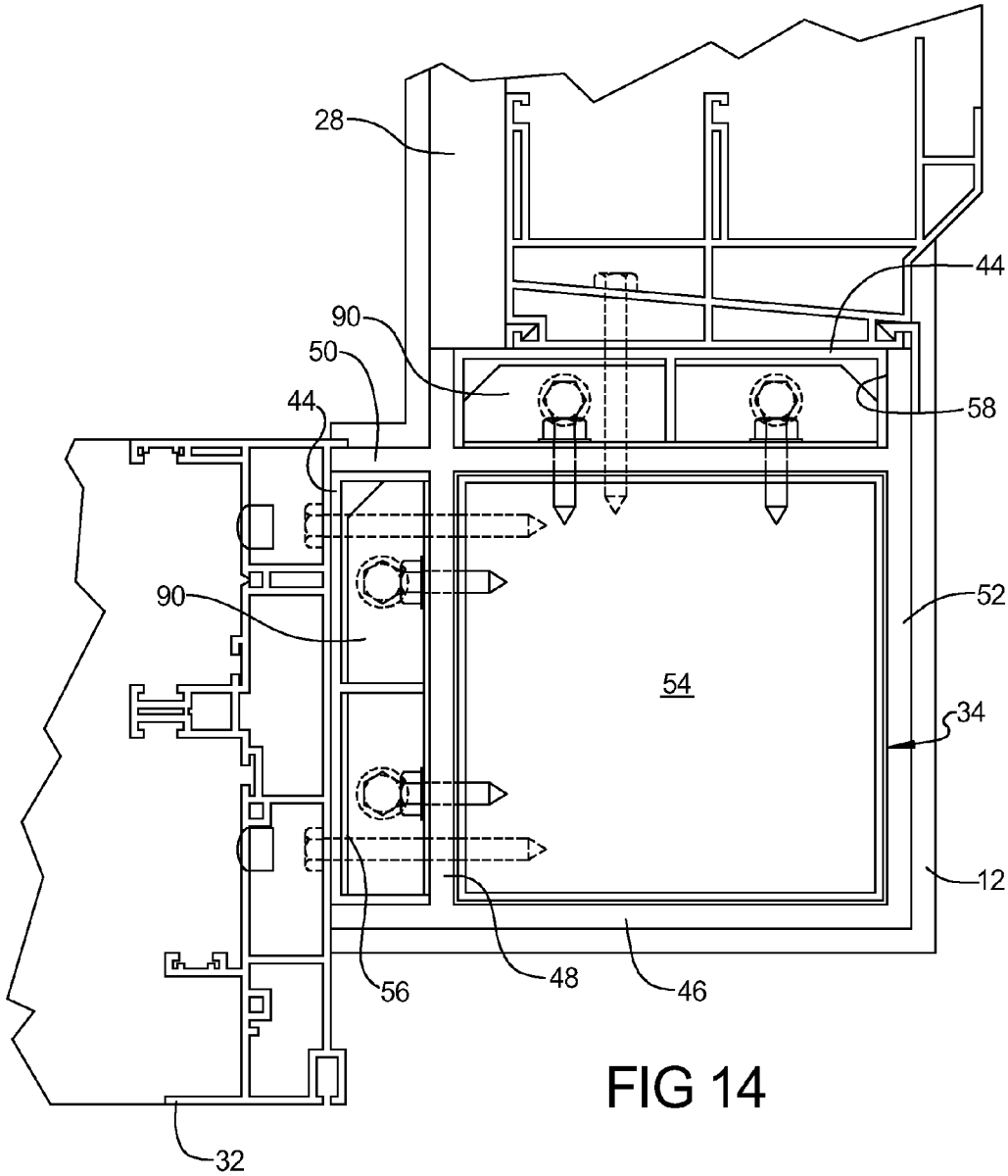
FIG. 14 is a section view taken along line 14-14 of FIG. 3 showing a box-shaped corner post having opposed channels for connecting the left and front wall panels to one another, and L-shaped flanges for connecting the corner post to a track member of the enclosure.

As shown in FIG. 14, a corner post 34 connects the vertical edges of the left and front walls 18 and 20. The corner post 34 extends vertically upwardly from the substrate 12 and is connected to two base tracks 38*a*, the base tracks extending horizontally along the substrate and at right angles to one another. The two base tracks 38*a* are connected to the substrate 12 by L-shaped flanges 90 in a manner described above. One L-shaped flange 90 is disposed in one base track 38*a* and has a vertical leg 90*a* received in the squared-C channel 56 and threadably fastened to the wall 48 of the corner post 34. The other L-shaped flange 90 is disposed in the other base track 38*a* and has a vertical leg 90*a* received in the squared-C channel 58 and threadably fastened to the wall 50 of the corner post beam.

A closure member 44 is snugly interfitted within the squared-C channels 56 and 58 wherein to provide the corner post 34 with a clean aesthetic appearance.

As shown in FIG. 1, the roof 22 is generally rectangularly shaped, angles downwardly from the exterior wall 14, and is generally coextensive with the front and side walls 16, 18 and 20 of the enclosure 10. The roof structure includes severally generally rectangularly shaped roof panels 26, a rearward channel bracket 98, a forward channel bracket 100, left and right end brackets 102 and 104, and a plurality of I-beams 36. The roof panels 26 are as described for the wall panels 24. Further, the channels 98 and 100 and end brackets 102 and 104 are comprised of a composite PVC, as described herein above.

The rearward channel bracket 98 is mounted to the exterior wall 14 and has an outwardly open channel 98*a* adapted to receive rearward lateral edges of the roof panels 26 and rearward end portions of the I-beams 36.

The forward channel bracket 100 has an outwardly open channel 100*a* adapted to receive forward lateral edges of the roof panels 26 and forward end portions of the I-beams 36.

Further, the channel bracket 100 includes an upwardly open channel 100*b* which forms a gutter or trough for directing water from the roof.

The left and right end brackets 102 ands 104 have outwardly open channels 102*a* and 104*a*, respectively, for receiving the lateral edge of a roof panel 26.

As assembled, the rear channel 98 is connected to the exterior wall 14. The rectangular roof panels 26 have their opposite longitudinal edge portions interfitted within the channel 63 and 65 of a respective I-beam 36, or left and right end bracket 100 and 102, and their opposite lateral edges ends interfitted within a channel 98*a* and 100*a* in the rearward and forward channel brackets 98 and 100. The opposite ends of the channel brackets 98 and 100 are connected to the opposite ends of the left and right end brackets 102 and 104.

As contemplated herein, the patio enclosure 10 may be advantageously supplied to the user in kit form, ready to go and for assembly to an existing structure. The kit for constructing an enclosure to the exterior wall of an existing structure generally comprises the various structural elements as described in detail herein above.

In particular, the kit comprises a plurality of wall panels 24 of predetermined height, width, and thickness, framing structure 28 and 32 for at least one window or door, a plurality of elongated track beams 38, the track beams forming upper and lower end caps of front and side walls 16, 18 and 20 formed by the kit, a plurality of vertical uprights 36 of I-shaped cross section, a plurality of corner posts 34, a plurality of C-shaped cross-beams 40, a plurality of closure members 44 of squared-C cross-section, the closure members being snap-fittable into a respective C-shaped channel provided in the I-beam and corner post, and fasteners 90 and 92 for positioning and securing the wall panels, framing structure, track beams, I-beams, corner posts, C-shaped cross-beams, and closure members to one another and the support structure.

Preferably, and according to this embodiment of the invention, the track beams, I-beam, corner-post, C-shaped cross-beam, and closure members of the kit are extruded or injection molded of a composite PVC, with predetermined exterior surfaces clad with a vinyl.

What I claim is:

1. A room structure for attachment to a building wall, the room structure having an upright frame assembly including an upper end and formed by at least one enclosure wall and a roof structure extending between the exterior wall and the upper end of the frame assembly, the frame assembly including at least one vertically disposed axially elongated support member, the support member comprising:

an assembly of an I-beam and a closure member, the I-beam and the closure member being of substantially the same axial length;

the I-beam and the closure member each being unitary and comprised of a single piece of a non-metallic composite material;

the I-beam being axially elongated and having a central body and a pair of transverse flanges, the flanges each having a pair of opposed outer edges positioned away from the central body, the flanges and the central body defining oppositely facing squared-C shaped channels; and the closure member being axially elongated and comprising a base wall, a pair of sidewalls, and at least one support wall, the sidewalls extending from opposite edges of the base wall and the at least one support wall upstanding from a medial location along the base wall;

wherein the closure member is snap-fitted in a friction fit into the squared-C channel of the I-beam to substantially close the channel and in a manner that the base wall of the closure member and the outer edges of the flanges of the squared-C channel into which the closure member is interfitted are substantially coplanar.

2. The room structure according to claim 1, wherein the central body of the I-beam is hollow and defines a substantially rectangularly-shaped passageway.

3. The room structure according to claim 1, wherein the I-beam and the closure member each comprise a PVC plastic material and a cellulosic material.

4. The room structure according to claim 1, wherein the frame assembly comprises an axially elongated base track having a base member and a pair of opposed arms, the base member having opposed lateral edges and the opposed arms being spaced apart and disposed thereon, the arms and the base member defining a track.

5. The room structure according to claim 1 wherein the frame assembly comprises an axially elongated corner post, the corner post having four walls which intersect to define a substantially square-shaped central opening and a pair of outwardly open squared-C shaped channels.

6. The room structure according to claim 1 wherein the I-beam and the closure member define an elongated access space therebetween, wherein the access space contains electrical wiring.

7. A room structure for attachment to the exterior wall of a building mounted on a foundation adjacent to said wall, said room structure comprising an upright frame assembly having an upper end and formed by at least one enclosure wall and a roof structure extending between said exterior wall and the upper end of said frame assembly, said frame assembly including at least one vertically disposed support member, the improvement wherein said support member comprises an assembly of an H-beam and a closure member, each said closure member and H-beam being comprised of a single piece of composite material and having substantially the same vertical height, said H-beam being formed by a spacer wall and a pair of webs, the spacer wall extending between the webs and disposed inwardly and between the outer edges of the webs wherein to form a pair of outwardly open squared-C channels, and said closure member being formed by a pair of sidewalls and a base wall, the sidewalls extending from opposite edges of the base wall wherein to form a squared-C cross-section, the closure member being snap-fittable in a friction fit into one of the squared-C channels of the H-beam to substantially close said channel and in a manner that the exterior base wall of the closure member and the edges of the webs of the squared-C channel into which the closure member is interfitted are substantially coplanar.

8. The room structure according to claim 7, wherein the spacer wall of said H-shaped beam is centrally apertured, the aperture extending between the opposite ends of the beam.

9. The room structure according to claim 7, wherein the H-shaped beam and C-shaped closure member are extruded from a composite PVC plastic.

* * * * *